US005826929A

United States Patent [19]

Tisbo et al.

[11] Patent Number: 5,826,929

[45] Date of Patent: Oct. 27, 1998

[54] COMBO SNOW REMOVAL TOOL

[75] Inventors: Thomas A. Tisbo, Barrington Hills; Stephen P. Whitehead, Elgin; Lyle Rosine, Aurora, all of Ill.

[73] Assignee: Suncast Corporation, Batavia, Ill.

[21] Appl. No.: 693,485

[22] Filed: Aug. 8, 1996

[51] Int. Cl.[6] ..... E01H 5/02

[52] U.S. Cl. ..... 294/54.5; 294/57

[58] Field of Search ..... 294/49, 51, 54.5, 294/55–59; 16/110 R, 111 R, 116 R, 119, 125; 37/241, 265, 268, 278, 284, 285; D8/10, 300, 303

[56] References Cited

U.S. PATENT DOCUMENTS

| | | | |
|---|---|---|---|
| D. 213,630 | 3/1969 | Hoxie et al. . | |
| D. 214,662 | 7/1969 | Portz | D8/10 |
| D. 257,210 | 10/1980 | Bonnes | 294/54 |
| D. 267,468 | 1/1983 | Simms | 294/54.5 |
| D. 269,490 | 6/1983 | Germain | D8/1 |
| D. 284,733 | 7/1986 | Hozumi | D8/10 |
| D. 291,863 | 9/1987 | Kolonia | D8/10 |
| D. 296,410 | 6/1988 | Abbott | 294/54.5 X |
| D. 306,962 | 4/1990 | Schuele | D8/13 |
| D. 328,553 | 8/1992 | Norton et al. | 294/54.5 |
| D. 331,652 | 12/1992 | Wu | D34/27 |
| D. 350,166 | 8/1994 | Kino | D21/120 |
| D. 360,564 | 7/1995 | Tisbo et al. | 294/49 |
| D. 363,653 | 10/1995 | Tisbo et al. | 294/49 |
| 366,099 | 7/1887 | Hinchman | 294/56 |
| D. 384,559 | 10/1997 | Tisbo et al. | D8/10 |
| D. 384,866 | 10/1997 | Tisbo et al. | D8/10 |
| D. 385,160 | 10/1997 | Tisbo et al. | D8/10 |
| 678,373 | 7/1901 | Blaser . | |
| 864,338 | 8/1907 | Schertzer . | |
| 930,660 | 8/1909 | Gifford | 294/54.5 |
| 964,453 | 7/1910 | Robarge . | |
| 967,270 | 8/1910 | Tiedt | 294/54.5 X |
| 1,042,352 | 10/1912 | Kohler | 294/54.5 |
| 1,260,276 | 3/1918 | Miller | 294/54.5 |
| 1,435,061 | 11/1922 | Halsey . | |
| 1,839,285 | 1/1932 | Winkle . | |
| 1,931,349 | 10/1933 | Habig | 97/227 |
| 3,119,596 | 1/1964 | Pratt | 254/131.5 |
| 3,177,026 | 4/1965 | Cowan | 294/54.5 |
| 3,680,641 | 8/1972 | Hein | 172/371 |
| 4,149,744 | 4/1979 | Bonnes | 294/54.5 |
| 4,247,141 | 1/1981 | Grint | 294/49 |
| 4,280,727 | 7/1981 | German | 294/54.5 |
| 4,538,847 | 9/1985 | Lapshansky | 294/51 |
| 4,655,494 | 4/1987 | Eads et al. | 294/49 |
| 4,690,447 | 9/1987 | Adams | 294/58 X |
| 4,848,073 | 7/1989 | Germain et al. | 56/400.17 |
| 4,878,704 | 11/1989 | Jacanin, Jr. et al. | 294/54.5 |
| 4,991,324 | 2/1991 | Fine et al. | 294/54.5 X |
| 4,993,768 | 2/1991 | Ewen | 294/57 X |
| 5,228,734 | 7/1993 | Pollastro | 294/54.5 |
| 5,419,600 | 5/1995 | Tisbo et al. | 294/54.5 |
| 5,435,063 | 7/1995 | Russo | 30/164.5 |

FOREIGN PATENT DOCUMENTS

| | | | |
|---|---|---|---|
| 234243 | 12/1959 | Australia . | |
| 2285163 | 4/1976 | France . | |
| 641210 | 1/1937 | Germany | 294/57 |
| 687817 | 2/1940 | Germany | 294/57 |
| 369590 | 3/1939 | Italy | 294/57 |
| 1009947 | 11/1965 | United Kingdom | 294/54.5 |
| 1173714 | 12/1969 | United Kingdom . | |
| 1424565 | 2/1976 | United Kingdom . | |
| 2063142 | 6/1981 | United Kingdom . | |

*Primary Examiner*—Johnny D. Cherry
*Attorney, Agent, or Firm*—Welsh & Katz, Ltd.

[57] ABSTRACT

A versatile combo snow tool is provided to easily push and lift snow. The convenient multi-user, combo snow tool has a special curved blade which is rounder than a conventional snow shovel but shallower than a conventional snow pusher. The combo snow tool has a comfortable ribbed handle assembly to facilitate better gripping of the snow tool. The handle assembly can have an extruded handle with a fluted plastic sleeve and a metal core. Desirably, the handle assembly also has a special ribbed handgrip to further enhance gripping of the combo snow tool.

10 Claims, 8 Drawing Sheets

108
106
84
104
86
76
96
100
101
98
88
80
91
93
82
90
92
75
78
74
60
64
62
68
66
10
72
25
44
42
22
24
12
26
30
32
28
41
14
39
37
35
34
36
38
40
18
20
104
76
118
82
78
79
103
60
75
74
64
62
68
66
72
12
42
44
10
28
32
16
49
20

108
106
84
104
86
76
96
100
101
88
80
98
91
82
93
90
92
75
78
74
60
64
62
68
66
10
25
72
44
42
22
24
12
26
32
28
30
41
14
37
35
36
20
38
40
39
54
34
52
18
49
16
118
79
103

COMBO SNOW REMOVAL TOOL

BACKGROUND OF THE INVENTION

This invention pertains to snow shovels and, more particularly, to manual snow tools.

Handheld portable snow tools, typically referred to as manual snow tools, are useful to remove snow, ice and slush from sidewalks and driveways. Over the years, various types of manual snow tools have been developed, such as snow shovels, pushers and scrapers. In the past, manual snow tools were constructed with a wooden handle and a steel or iron blade or scoop. Conventional snow tools are often bulky, heavy and cumbersome to use. In an effort to improve the ease of use and decrease the weight of snow tools, snow tools have been made with aluminum handles and/or aluminum blades. Aluminum handles can be very slippery and difficult to hold when wet, such as when it snows or sleets. In modern times, part of the snow tools has been fabricated of plastic. Early snow tools with plastic blades were somewhat flimsy and did not wear well. Furthermore, snow tools with smooth, plastic rounded handles can also be slippery and difficult to hold when wet.

Scrapers are useful to scrape, cut and chop ice from sidewalks and driveways. Smaller scrapers are useful to scrape ice from vehicle windows and windshields. Ice can accumulate on sidewalks and driveways from ice storms or from snow which has melted during the day and freezes at night when the temperature drops. Icy sidewalks and driveways can be very dangerous and slippery. It is often difficult to walk and safely drive with full control on icy pavements. If snow falls and accumulates on the ice, the underlying layer of ice can be treacherous.

Small amounts of snow can be readily removed from sidewalks, stairs and driveways with a snow shovel. Snow shovels are good all around snow tools. Typically, snow shovels have a generally flat blade with a very slight curvature. Snow shovels are useful to shovel, lift, raise and throw light snow away from the sidewalk, stairs or driveway. If the snow is deep, heavy, or slushy, other types of snow tools are better, safer and more productive than standard snow shovels. Moreover, lifting heavy snow with a standard snow shovel may cause back injuries and sometimes heart problems for some people.

Snow pushers have a rounded or curved blade which is useful to push heavy or deep snow and slush away from sidewalks and drivers. Snow pushers can be very heavy. The deep curvature of pusher blades, however, is not generally useful to lift (raise) and throw snow and slush, which remain after the bulk of the snow and slush has been pushed away. Furthermore, many snowfalls, such as 2½ inches to 5 inches of snow, are too deep to comfortably use only a snow shovel, but too shallow (not deep enough) to use only a snow pusher.

In order to manually remove snow from sidewalks, driveways and pavements, different amounts of effort are often required to remove the snow, depending on the depth, temperature, fluffiness, amounts of slush, water, ice and texture of the snow to be removed. Sometimes, women, children and older men may become overburdened and frustrated by the weight and bulkiness of a regular snow pusher when removing light snow. Also, regular snow pushers can be too heavy, awkward and cumbersome to shovel, lift and throw light snow for some women, children and older men. On the other hand, conventional flat snow shovels are usually inadequate and unsuitable to push and remove heavy, wet and slushy snow.

It is, therefore, desirable to develop an improved snow tool which overcomes most, if not all, of the preceding problems.

SUMMARY OF THE INVENTION

An improved manual snow tool is provided to quickly, comfortably and efficiently remove snow from sidewalks, driveways, curbs, and outdoor stairways (exterior stairs). The attractive snow tool is easy to use, durable and reliable. Advantageously, the multi-use snow tool is safer, convenient, lighter and more economical than bulky conventional snow shovels and heavy snow pushers.

In order to better grip and readily minimize slippage of the snow tool, the snow tool has a ribbed handle assembly. The comfortable readily graspable handle assembly is operatively associated with the snow blade to better and more easily maneuver the snow tool and blade. The snow tool has a ribbed handle assembly. The handle assembly can have ribs or furrows. Preferably, the handle assembly comprises an extruded handle with fluting. The extruded handle can include an extruded fluted tube, shaft or shank with ridges that extend towards the blade. Desirably, the handle comprises a light-weight ribbed plastic tube which provides an easily grippable plastic sleeve that can have raised finger pads.

The user-friendly handle assembly can comprise a composite ribbed handle, which is operatively connected to the snow blade to lift and/or push the blade. In the preferred form, the composite handle has a metal core positioned within a plastic sleeve. The metal core can be a steel, iron or aluminum pipe. The plastic sleeve or tube can encircle and annularly and peripherally surround the metal core. Preferably, the plastic sleeve has finger-gripping grooves which extend substantially parallel to the axis of the sleeve and handle towards the blade.

The light weight handle assembly can also have a plastic ribbed handgrip to help push the blade and further facilitate gripping of the snow tool. The handgrip can be securely connected to the upper end of the composite tubular handle. The handgrip preferably comprises a comfortable D-shaped plastic handgrip with finger grippable ribs. The handgrip can have a textured surface as well as raised flanges to enhance the structural strength and integrity of the handgrip.

The snow tool has a strong snow blade to shovel, push or scrape snow. Preferably, the blade comprises a special combo (combination) snow blade with a sufficient curvature to push, shovel, lift and raise snow. Desirably, the combo snow blade is rounder than a flat shovel blade and is flatter, shallower, and less curved than a conventional pusher blade. As discussed, the handle assembly has an elongated shaft (handle) connected to the blade and has a handgrip connected to the shaft to manually move the blade. In the preferred form, the combo blade comprises a plastic blade with ribs. The combo snow tool combines the best features of a shovel and a pusher. The deeper blade and angled rib pattern allow the combo snow tool to plow through snow while a streamlined design and lightweight construction provide for easy lifting.

A metal wear strip can be secured to the leading or front edge of the combo blade. The metal wear strip can be made of steel, iron or other metal. The metal wear strip can be used to help scrape, chop and remove ice, but is primarily used to resist wear and improve the longevity and useful life of the blade.

A more detailed explanation of the invention is provided in the following description and appended claims taken in conjunction with the accompanying claims.

DETAILED DESCRIPTION OF THE PREFERRED EMBODIMENTS

Figure 1:
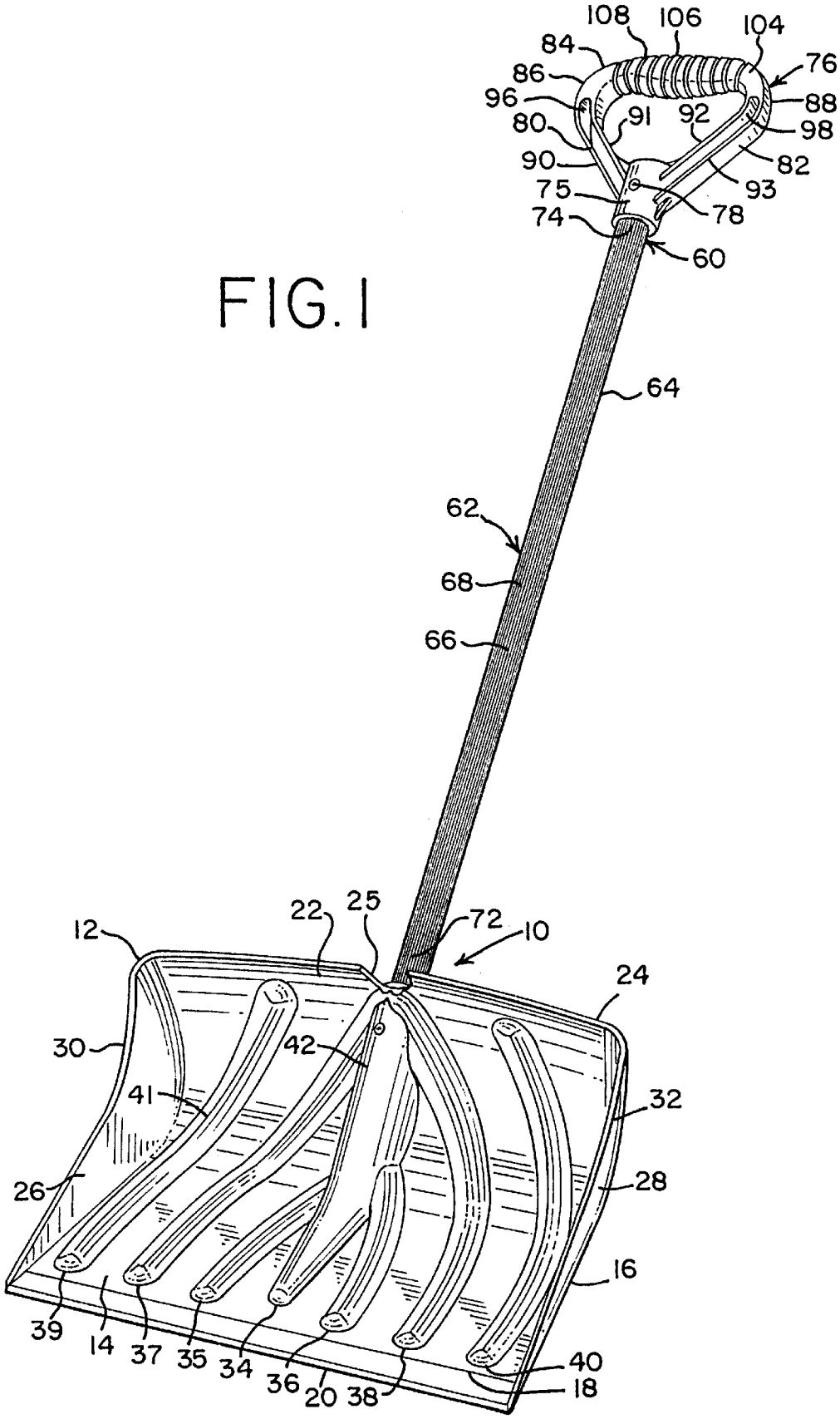
FIG. 1 is a perspective view of a combo snow tool without a wear strip in accordance with principles of the present invention.

A handheld, manual, portable, combination snow tool 10 (FIG. 1), also referred to as a combo snow tool, multi-use (multiple user) snow tool or combo, is provided to manually push, shovel, lift, raise and remove snow from pavements, such as sidewalks and driveways, wooden exterior stairways, concrete stairs, and curbs. The combo snow tool is particularly useful when the snow is too deep to shovel, but too shallow to only push, such as for 2½ inches to 5 inches of snow.

The snow tool has a curved, rounded combination (combo) snow blade 12 fabricated of impact—resistant plastic, such as polypropylene or polyethylene, or graphite—impregnated plastic. The curved blade has a concave, arcuate, front blade surface 14 (FIGS. 1 and 2) to push, engage, pickup and lift snow and has a convex back (rear) blade surface 16 (FIGS. 3–6) which supports the front surface. Significantly, the concave front surface of the combo blade has a depth of curvature which is shallower, flatter and less round than a conventional snow pusher (pusher blade) and has a radius of curvature which is greater than a conventional pusher (pusher blade) so that the concave front blade surface of the combo blade can effectively and easily shovel, pickup, lift and throw snow. The concave front blade surface of the combo blade has a greater curvature than the generally flat snow shovel blade of a conventional snow shovel so that the concave front blade surface of the combo blade can effectively push snow. Combo blades have been successfully constructed by applicants with sizes ranging from 18"×12" to 20"×13" and a radius of curvature ranging rom 5.4" to 5.6".

The combo snow blade has a lower portion 18 (FIG. 1) providing a leading edge or front edge 20 and has an upper portion 22 providing a trailing edge or back edge 24. The upper portion can have a cutaway section that provides a notch or U-shaped opening 25 along the centerline of the blade to facilitate nesting, stacking, and storage of similar blades. The combo blade also has curved sidewalls 26 and 28 which extend between and are integrally connected to the upper and lower portions of the blade. The curved sidewalls have concave upper edges 30 and 32 which can have a greater and deeper depth of curvature and a smaller radius of curvature than the front surface of the combo blade. The upper edges of the curved sidewalls can have a radius of curvature ranging from 6.4" to 6.9". The sidewalls help contain, scoop and collect the snow on the curved front blade surface during shoveling, pushing and lifting of the combo snow tool.

The blade further has inverted V-shaped bifurcated ribs of ridges 34–40 (FIGS. 1 and 2) also referred to as reinforced ribs or curved reinforcement ribs. The inverted V-shaped ridges comprising the ribs of the blade project integrally outwardly (forwardly) of the front blade surface and extend between the lower and upper portions to enhance the structural strength and integrity of the combo snow blade. The blade's ribs are generally V-shaped as viewed from the back surface of the blade. Preferably, the ribs include curved flared ribs 35–40 which converge laterally inwardly away from the blade's sidewalls and toward the axis of the handle and centerline of the blade in a direction towards the blade's upper portion. The blade's ribs facilitate pushing, shoveling and channeling of the snow towards the back edge of the upper portion of the blade's front surface. The blade's ribs also help prevent the channeled snow from falling off the leading edge of the blade. Desirably, the blade's angled ribs throw and push more snow forward creating a powerful snowplow effect.

The blade's ribs include: a center rib 34, inboard ribs 35 and 36, intermediate ribs 37 and 38, and outboard ribs 39 and 40. The ribs can have rounded apexes 41. The inboard ribs converge towards and are integrally connected to a intermediate portion of the blade's center rib. The intermediate ribs are spaced between the inboard and outboard ribs and converge towards and are integrally connected to the upper portion of the center rib adjacent the back edge of the blade's front surface. The outboard ribs are spaced between the sidewalls and the intermediate ribs and curve inwardly towards the back edge of the blade's front surface. The center rib extends along the centerline of the blade and is in alignment with the axis of the handle (handle assembly).

The upper portion of the center rib is deeper than the lower portion of the center rib and forms a socket 42, as best shown in FIGS. 3, 4, 14 and 15, which provides a coupler or shaft coupling, to snugly receive the lower end of the handle. The socket (coupler) of the blade extends integrally downwardly from the blade's back surface. One or more screws 44 and 45 (FIGS. 2, 4, 14 and 15) or other fasteners can be used to securely fasten the coupler of the blade to the handle.

A center flange 46 (FIG. 4) provides a tab or back rib, which extends integrally downwardly from the center rib and back surface of the blade. The center flange extends along the centerline of the center rib and blade. A short transverse flange 48 provide a lateral tab or transverse rib which extends integrally downwardly from the center rib and the blade's back surface. The transverse flange intersects the center flange and extends between and connects the centerlines of the inboard ribs. The transverse flange is much shorter than the center flange. The flanges further enhance the structural strength of the combo blade.

The back surface of the leading edge of the lower portion of the back surface of the blade has peripheral ridges or flanges comprising a raised wear pad 49 (FIGS. 4 and 5) or wear section. The wear pad surrounds and defines a recessed rivet pocket or depression providing a seat 50 to snugly receive and matingly engage a metal wear strip 52 (FIGS. 8–15). The ridges and pocket can be generally rectangular with outwardly diverging sides. The wear strip, which is also referred to as a wear-resistant strip, edge, metal, skid, protector or reinforcement strip, protects the leading edge of the blade and enhances the longevity and useful life of the blade. The wear strip can be made of stainless steel, galvanized steel, carbon steel, iron and its alloys, or other metal. The wear strip preferably has a hardness of at least 70 on the Rockwell B scale and can be tempered. The wear strip can be connected to the seat along a recessed rivet pocket by rivets 54 or other fasteners. The pocket can have aligned rivet-receiving holes. The recessed rivet pocket allows shoveling and scraping to occur without wearing the heads of the rivets. The raised wear pad provides enhanced structural strength for the leading edge of the blade to allow the snow blade to be constructed with or without wear strips. The combo blade is designed and arranged for strength, longevity and durability, with or without wear strips.

Figures 2, 3:
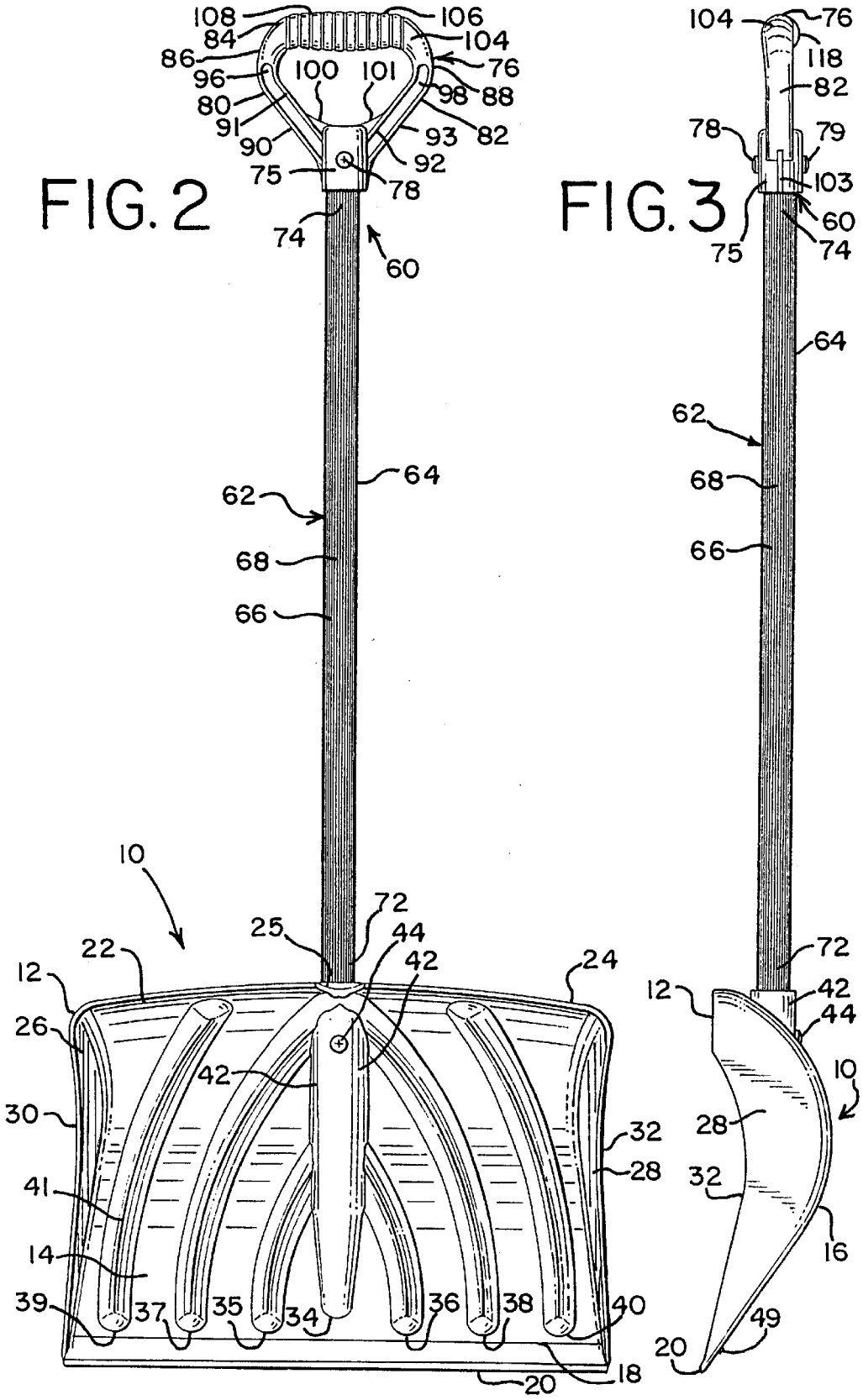
FIG. 2 is a front view of the combo snow tool.
FIG. 3 is a left side view of the combo snow tool.
Figure 4:
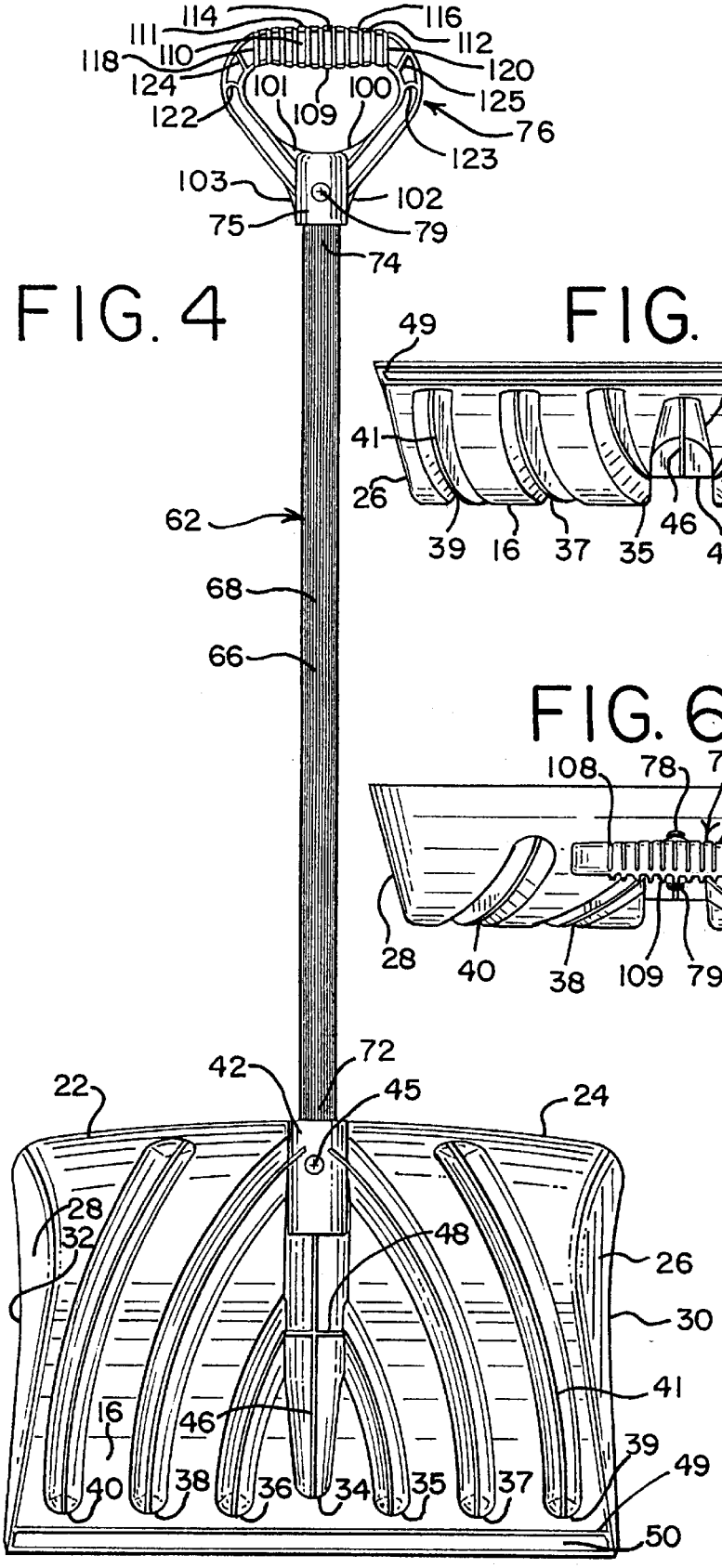
FIG. 4 is a back view of the combo snow tool.
Figure 5:
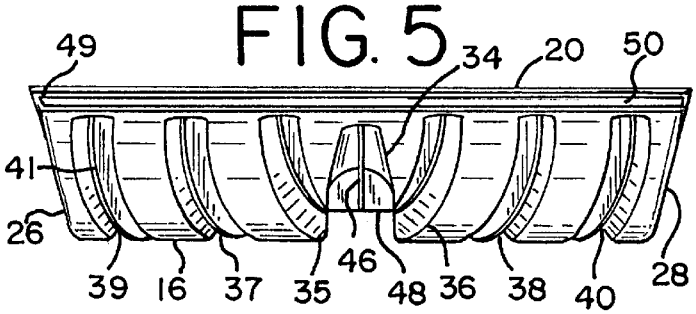
FIG. 5 is a bottom end view of the combo snow tool.
Figure 6:
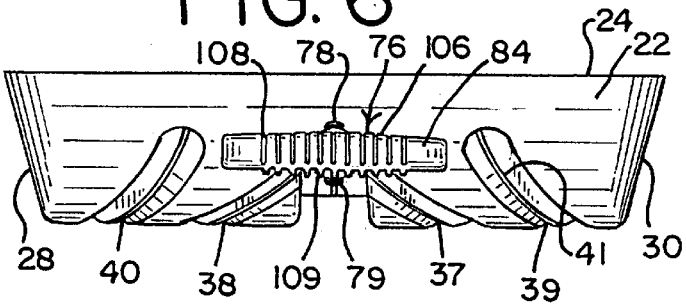
FIG. 6 is a top end view of the combo snow tool.
Figure 7:
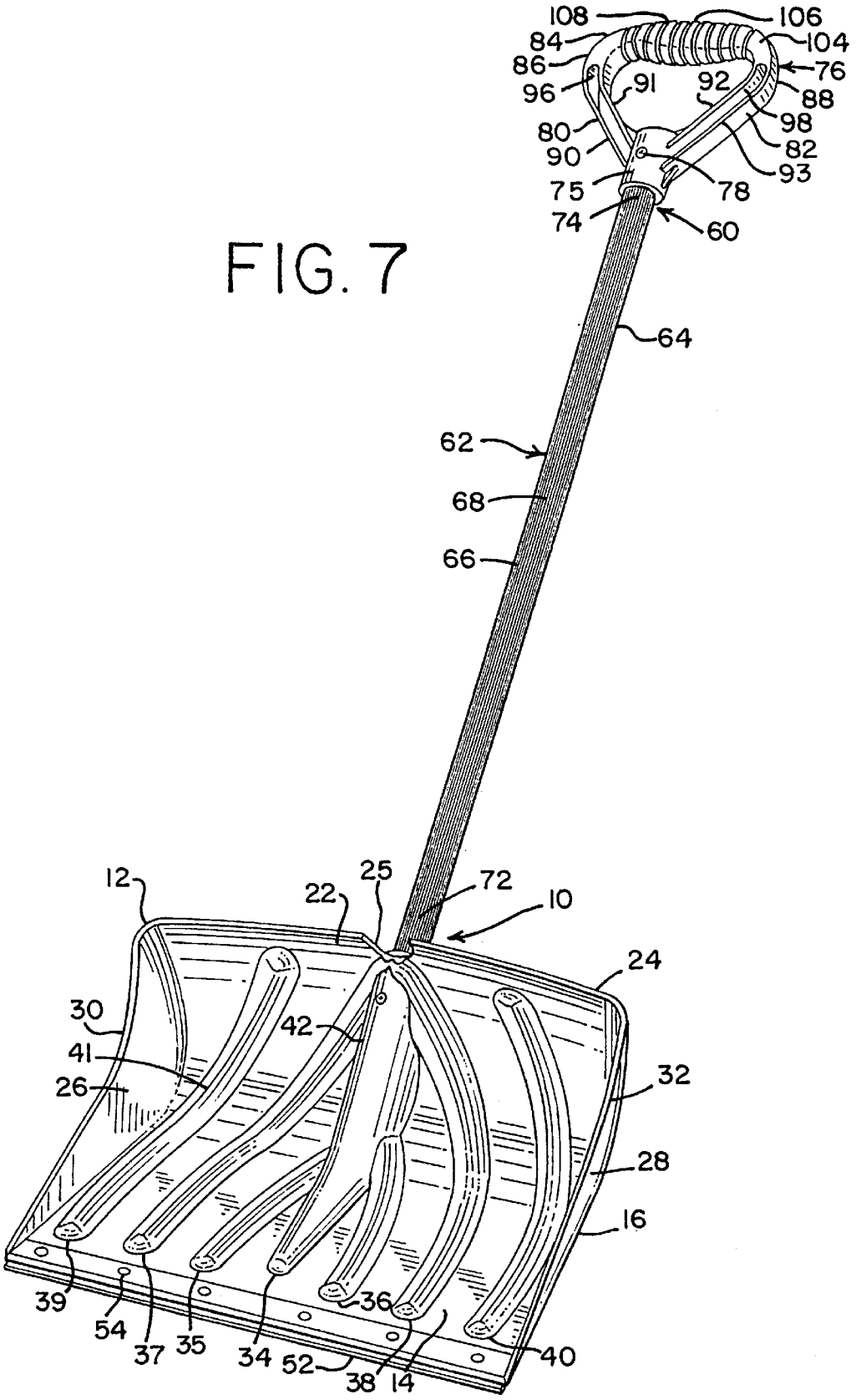
FIG. 7 is a perspective view of the combo snow tool with a wear strip in accordance with principles of the present invention.
Figures 8, 9:
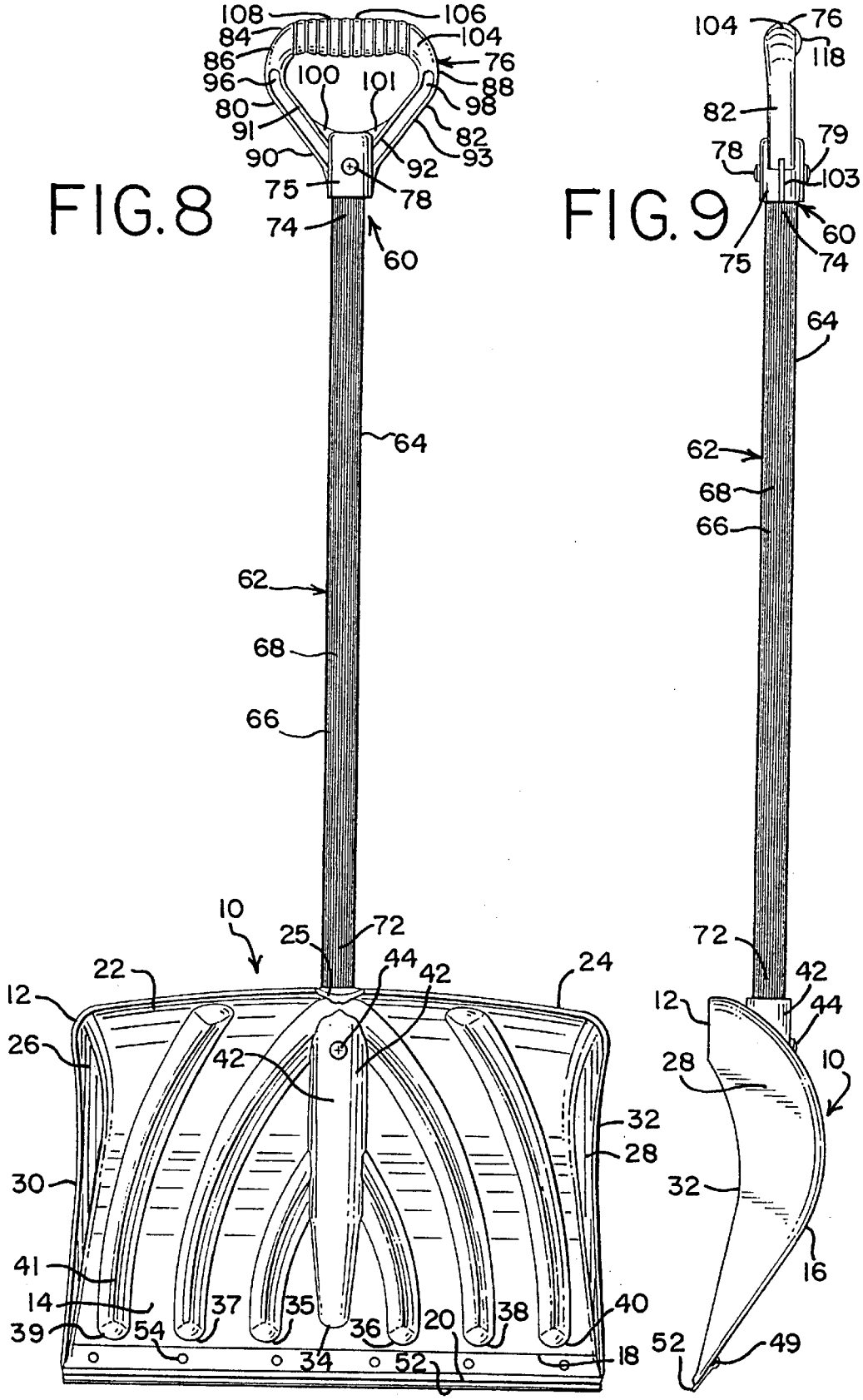
FIG. 8 is a front view of the combo snow tool with a wear strip.
FIG. 9 is a left side view of the combo snow tool with a wear strip.
Figure 10:
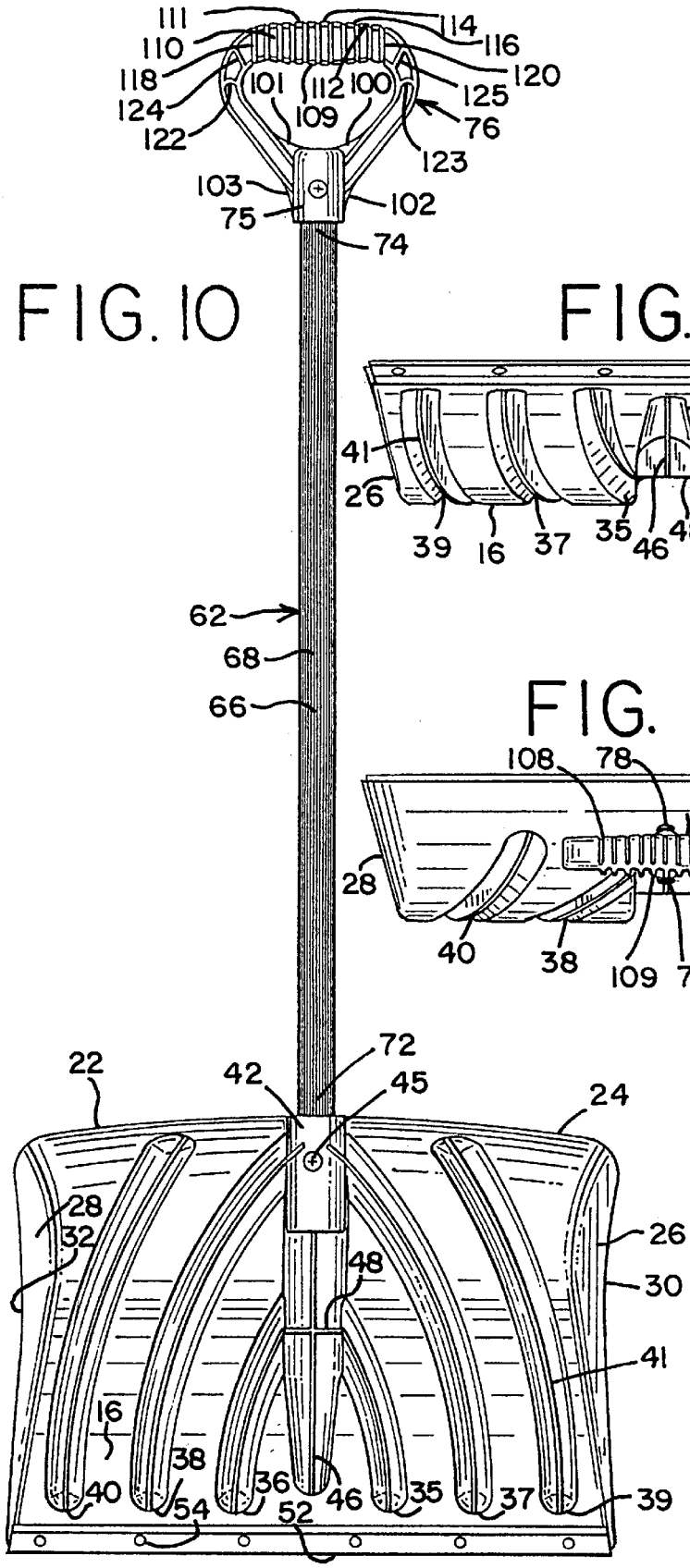
FIG. 10 is a back view of the combo snow tool with a wear strip.
Figure 11:
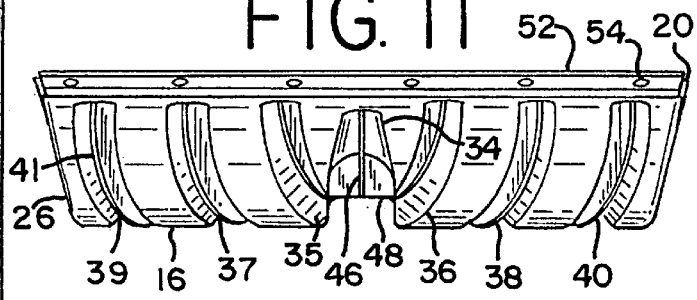
FIG. 11 is a bottom end view of the combo snow tool with a wear strip.
Figure 12:
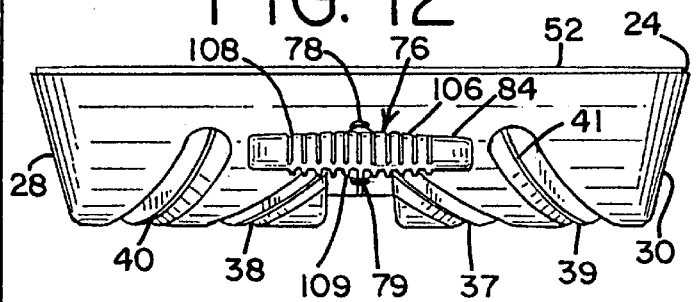
FIG. 12 is a top end view of the combo snow tool with a wear strip.

A ribbed composite handle assembly 60 (FIG. 1) is provided to better grip the snow tool and maneuver, push, shovel and lift the blade. The ribbed handle assembly has an elongated tubular, manually grippable composite shaft or shank 62 providing a ribbed fluted handle. In the embodiment of FIG. 1, the handle is straight. The handle includes a ribbed, plastic, resin, axially (longitudinally) lined sleeve 64 comprising an extruded fluted tube or sheath of impact-resistant plastic, such as polypropylene, polyethylene, or polyvinyl chloride. In order to enhance gripping, the fluted tube has elongated, aliquotly and circumferentially spaced, parallel ribs 66 which provide longitudinally, raised, rounded convex, finger-gripping pads or ridges in the axial direction. The ribs of the tubular handle (sleeve) are separated by elongated grooves 68 which provide finger-gripping slots or slits that extend parallel to the axis of the shaft (handle) and towards the blade and handgrip. The grooves provide parallel fluting or furrows which can extend along the entire length of the tube (handle) to further enhance gripping of the snow tool. The sleeve (tube) can have 36 circumferential ribs and flutes (fluting) which cooperate with each other to provide convex pads. Each rib of the sleeve is rounded and can extend for 10 degrees. The tube can be semi-rigid, yet flexible to withstand impact forces, bending and torque associated with shoving, pushing, scraping and throwing snow.

In order to improve the structural strength, bending resistance, torsion and torque capacity of the handle, an interior metal core 70 (FIGS. 14 and 15) is snugly positioned within the exterior plastic tube (sleeve). The inner core 70 is preferably hollow and tubular to decrease the weight of the handle and can comprise a steel tube or metal pipe made of steel, iron or other metal. The ribbed plastic sleeve provides a protective cover which annularly surrounds, encircles, and thermally insulates the metal core. The plastic sleeving overcoats the steel tube. The lower blade-connecting male end 72 of the handle telescopically fits and is positioned within and is coupled to the female socket (coupling) of the blade. The blade coupling (socket) closes and seals the lower blade-connecting end of the tubular handle. The upper handgrip-connecting male end 74 of the handle telescopically fits and is positioned within and is coupled to a female socket 75 of a ribbed, D-shaped, plastic ergonomic handgrip 76. The female socket, which is also referred to as a handgrip coupling, provides a cap which covers and closes the upper end of the tubular handle. One or two screws 78 and 79 or fasteners can securely connect and fasten the upper handgrip-connecting end of the handle to the handgrip coupling (socket).

The ribbed handgrip 76 (FIG. 1) is specially shaped, arranged and constructed to further enhance gripping of the snow tool and facilitate moving, pushing, shoveling, lifting, control and maneuvering of the blade and snow tool. The handgrip is connected to the upper end of the handle (shaft) at a location longitudinally (axially) opposite and spaced away from the blade. The handgrip is preferably molded of impact-resistant plastic, such as polyethylene or polypropylene. The handgrip can have bifurcated, V-shaped, flared, spread and slanted sides 80 and 82 which converge toward the handle (shaft) and are integrally connected to the sides of the handgrip coupling (socket).

A manually grippable crossbar or bight 84 (FIGS. 1 and 2) extends transversely across, laterally between and is integrally connected to the sides of the handgrip. The crossbar (bight) closes the upper diverging end of the spread sides of the D-shaped handgrip. Preferably, the crossbar and sides intersect each other with rounded finger-engageable corners 86 and 88. The corners are curved to comfortably receive the thumb of the user's hand to further facilitate gripping of the snow tool.

The sides of the handgrip have raised flanges 90–93 (FIG. 1) comprising inner and outer converging ribs to enhance the structural strength of the handgrip. Each of the sides has a pair of parallel flanges which extend integrally upwardly and downwardly from and are separated by flat or planar pads 96 and 98. The pads are spaced between and are integrally connected to the flanges. The pads and flanges cooperate with each other to provide further gripping surfaces. Inner curved webs 100 and 101 (FIGS. 2 and 4) provide interior, arcuate, lateral ribs which extend between and integrally connect the inner flanges 91 and 92 of the sides to the cap (socket) of the handgrip. Outer curved webs 102 and 103 (FIG. 4) provide exterior, arcuate, lateral ribs which extend between and integrally connect the outer flanges 90 and 93 of the sides to the cap (socket) of the handgrip.

The crossbar (bight) of the handgrip has a manually grippable portion comprising a textured convex upper surface 104 (FIG. 1) with an array, series or set of raised convex, textured, finger-gripping pads 106 that provide curved arcuate ridges. The ridges (finger-gripping pads) are separated by aliquotly, uniformly spaced, convex, arcuate, parallel grooves 108. The textured surface, ridges (finger-gripping pads), and grooves cooperate with each other to facilitate gripping of the handgrip. The front inner face 109 (FIG. 4) of the crossbar provides a finger-gripping front surface which can be slightly convex in the crosswise (lateral) direction and can have a bulging, rounded intermediate section which complements the curvature of the user's curled fingers when grasping the handgrip to further facilitate gripping of the handgrip and snow tool.

The manually grippable portion (crossbar) of the handgrip has a ribbed convex lower surface 110 (FIG. 4) which extends integrally downwardly from the textured upper surface. The ribbed lower surface has aliquotly, uniformly spaced, rounded, finger-gripping ribs 111 comprising parallel convex disc sections 112 which depend (extend) integrally downwardly from the textured upper surface to further facilitate gripping of the bight (crossbar) and snow tool. The center and intermediate disc sections (ribs) 114 and 116 are larger and extend downwardly a greater distance than the other disc sections (end ribs) 118 and 120. Furthermore, the disc sections preferably have an overall convex profile in the crosswise (lateral) direction which is complementary to the palm of the user's hand to comfortably fit into the palm of the user's hand. The disc sections further facilitate gripping of the handgrip and pushing, shoveling and grasping of the snow tool.

Rearwardly convex curved ribs 122 and 123 (FIG. 4) and flared rearwardly diverging ribs 124 and 125, as viewed from the bottom of the handgrip, can extend between and integrally connect the bottom flange of the handgrip's sides about the rounded corners of the handgrip to further enhance the structural strength of the handgrip. The upper and lower portions 126 and 128 (FIGS. 14 and 15) of the handgrip can be integrally connected along a mold parting line 130 or flange.

Figure 13:
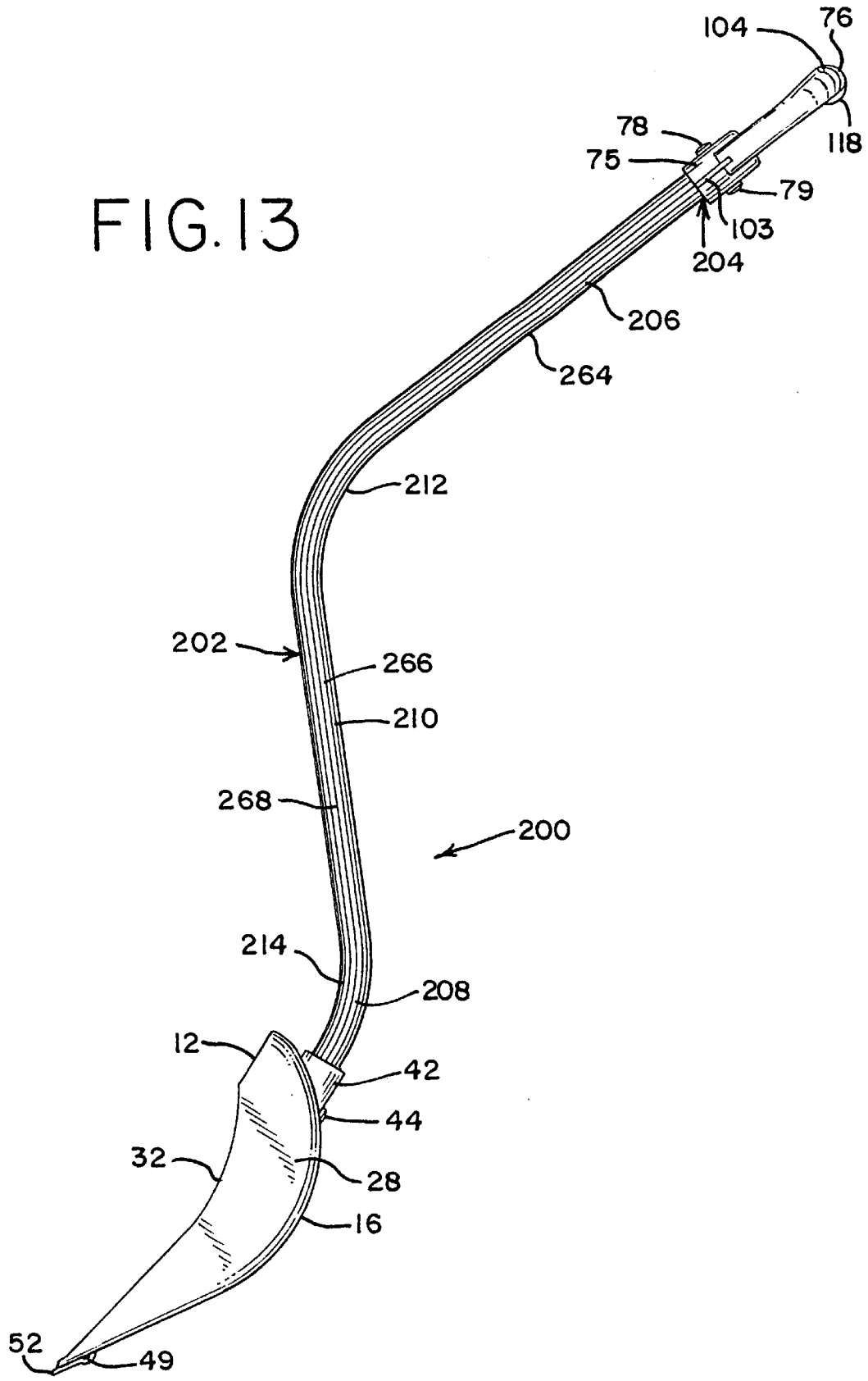
FIG. 13 is a left side view of a combo snow tool with an ergonomic bent handle in accordance with principles of the present invention.
Figure 14:
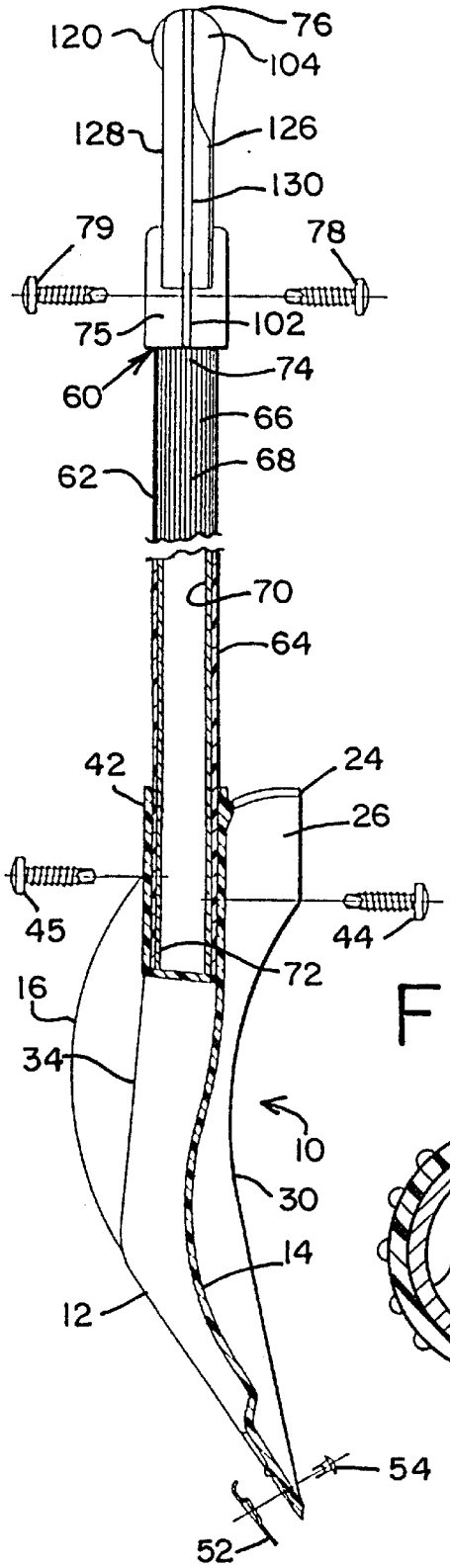
FIG. 14 is an enlarged, fragmentary, right side, partially exploded, assembly view, shown partially in cross-section, of the combo snow tool with a wear strip.
Figure 15:
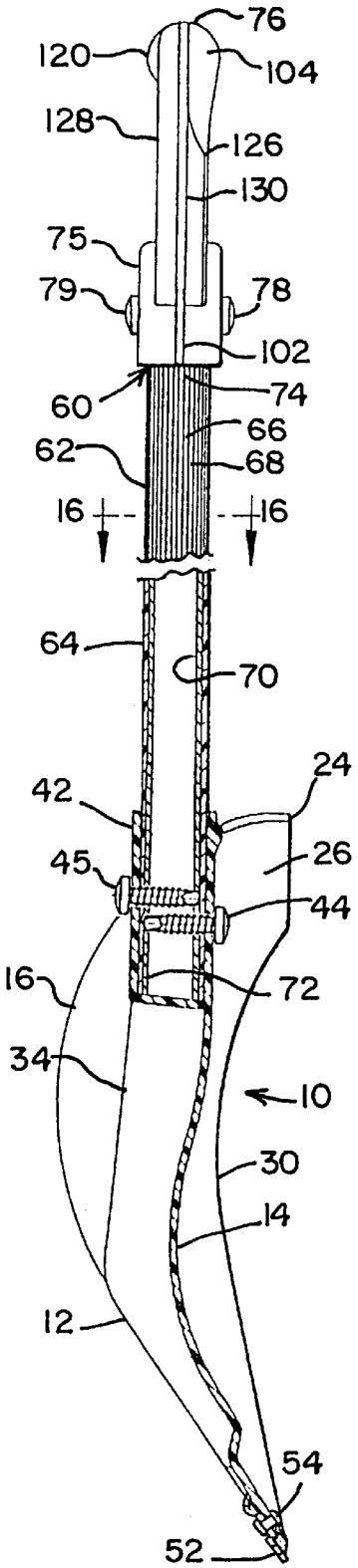
FIG. 15 is an enlarged, fragmentary, right side view, shown partially in cross-section, of the assembled combo snow tool with a wear strip.
Figure 16:
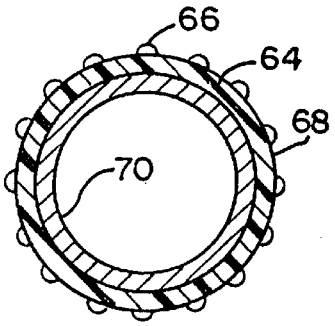
FIG. 16 is a cross-sectional view of the combo snow tool taken substantially along line 16—16 of FIG. 15.

The ergonomic combo (combination) snow tool 200 of FIG. 13 is structurally and functionally similar to the combo snow tool of FIGS. 1–12 and 14–15, except that the ribbed fluted handle 202 providing the manually grippable composite shaft or shank of the ribbed handle assembly 204 comprises an ergonomic bent handle. The ergonomic handle is curved, bent, shaped and contoured to help minimize back stress and strain when pushing, shoveling and lifting the combo snow tool. The ergonomic handle has: an elongated upper handle portion (section) 206 which snugly fits into and is securely attached to the socket (cap) of the handgrip, a shorter lower handle portion (section) 208 which snugly fits into and is securely attached to the blade's socket (coupling), and an intermediate handle portion (section) 210 which extends between and is integrally connected to the upper and lower handle portions. The intermediate handle portion is slightly shorter or the same length as the upper handle portion of the ergonomic handle, and is preferably much longer than the lower handle portion of the ergonomic handle. The ratio of the upper handle portion of the ergonomic handle, relative to the intermediate and lower handle portions of the ergonomic handle, respectively, can be: 16.466: 12.465: 3.773.

The upper end portion of the ergonomic handle can intersect the intermediate handle portion of the ergonomic handle at an obtuse angle of inclination, such as at 100–140 degrees, preferably 120 degrees. The intersection of the ergonomic handle's upper handle portion and the intermediate handle portion, preferably comprises a downwardly facing grippable, upper rounded corner 212 (FIG. 13) which can complement and comfortably fit in the palm of the user's hand. The upper rounded corner can have an arc length and angle of curvature ranging from 45–75 degrees, preferably 60 degrees. The lower handle portion of the ergonomic handle can intersect the intermediate handle portion of the ergonomic handle at an obtuse angle of inclination, such as 120–170 degrees, preferably 145 degrees. The intersection of the ergonomic handle's lower handle portion and the intermediate handle portion, preferably comprises an upwardly facing, lower rounded corner 214. The lower rounded comer can have an arc length and angle of curvature ranging from 25–55 degrees, preferably about 38 degrees. The lower rounded corner can have the same radius of curvature as the upper rounded corner.

The ergonomic bent handle 202 (FIG. 13) has a ribbed, plastic resin, axially (longitudinally) lined, ergonomic bent sleeve 264 comprising an extruded bent, fluted tube of impact-resistant plastic, such as polypropylene or polyethylene, and has a hollow, tubular ergonomic bent metal core made of steel, iron or other metal positioned within the plastic sleeve. As in the straight handle embodiment of FIGS. 1–12 and 14–15, the fluted tube has elongated, aliquotly and circumferentially spaced parallel ribs 266 which provide raised finger-gripping convex pads. The ribs on the sleeve provide finger-gripping ridges which are separated by elongated grooves 268 that extend parallel to the axis of the shaft (handle) and towards the blade and handgrip. The ridges can comprise parallel fluting or furrows which can extend along the entire length of the sleeve to further enhance gripping of the handle and ergonomic combo snow tool. The bent sleeve and core of the ergonomic bent handle are structurally similar and functionally similar to the straight sleeve and core of the straight handle of the embodiment of FIGS. 1–12 and 14–15, except they are bent and curved as described above. The ergonomic bent handle can be slightly longer than the combo snow tool of FIGS. 1–12 and 14–15.

The ergonomic combo snow tool and the straight handle combo snow can readily shovel, pickup, push, lift and throw snow. The combo snow tools are particularly helpful when the snow is too deep for a conventional snow shovel and too shallow or light for a conventional snow pusher.

Among the many advantages of the combo snow tools are:

1. Superior universal multi-purpose snow tools.
2. Dual use as a snow pusher and snow shovel.
3. Readily picks up and throws snow.
4. Manually plows and pushes snow.
5. Better capability and flexibility than standard snow shovels to push snow.
6. Better ability to shovel, lift and throw snow than standard show pushers.
7. Superb performance.
8. Excellent snow removal.
9. Attractive.
10. Safe
11. Dependable.
12. User friendly.
13. Convenient.
14. Durable.
15. Portable.
16. Light weight.
17. Comfortable.
18. Simple to use.
19. Efficient
20. Versatile
21. Economical.
22. Effective.

Although embodiments of the invention have been shown and described, it is to be understood that various modifications and substitutions, as well as rearrangements of parts, components, and process steps, can be made by those skilled in the art without departing from the novel spirit and scope of this invention.

What is claimed is:

1. A combo snow tool for manually pushing and shoveling snow, comprising:

a curved combination snow blade of impact-resistant plastic having a concave front surface for engaging snow and a convex back surface, said curved snow blade having a lower portion providing a leading edge and an upper portion providing a trailing edge, and said blade having ribs extending between said lower portion and said upper portion for enhancing the structural strength of said curved combination blade;

a ribbed handle assembly for manually maneuvering said blade, comprising an elongated tubular manually grippable shaft providing a ribbed handle of impact-resistant plastic connected to said curved blade, said ribbed handle having an axis and a set of elongated circumferential ribs providing raised convex ridges, said circumferential ribs being separated by elongated grooves extending substantially parallel to said axis towards said blade, and said circumferential ribs cooperating with said elongated grooves for enhancing gripping of said combo snow tool;

a generally D-shaped plastic handgrip connected to said ribbed handle at a location spaced from said curved blade, said ribbed handle extending between and secured to said handgrip and said curved blade, said handgrip having flared sides converging toward said ribbed handle and a bight providing a manually grippable portion extending between and integrally connecting said flared sides;

said flared sides of said handgrip have raised flanges comprising inner and outer converging ribs for enhancing the structural strength of said handgrip;

said manually grippable portion of said handgrip having a textured convex upper surface with an array of raised convex textured pads separated by aliquotly spaced arcuate grooves for facilitating gripping of said handgrip, and said manually grippable portion of said handgrip having a ribbed convex lower surface extending integrally downwardly from said textured upper surface of said handgrip, said ribbed lower surface having aliquotly spaced, convex finger-gripping ribs for enhancing the structural strength of said handgrip and for facilitating gripping of said bight.

2. A snow tool in accordance with claim 1 said elongated grooves and said convex ridges of said handle extend between said handgrip and said blade for substantially the entire length of said handle.

3. A snow tool in accordance with claim 1 wherein said shaft comprises a composite shank with a metal tubular core and said handle comprises a ribbed plastic sleeve positioned about and annularly surrounding said core for insulating said metal core from the user's hands.

4. A snow tool in accordance with claim 1 wherein said ribbed handle of said elongated tubular manually grippable shaft comprises a bent handle.

5. A snow tool in accordance with claim 1 wherein said ribbed handle of said elongated tubular manually grippable shaft comprises an extruded handle with longitudinal ribs and said handgrip includes a socket providing a cap connected to said flared sides of said handgrip for receiving said ribbed handle.

6. A snow tool in accordance with claim 1 wherein said blade has curved sidewalls extending between said upper and lower portion, and said sidewalls has concave upper edges.

7. A snow tool in accordance with claim 6 wherein said blade comprises a graphite impregnated plastic blade.

8. A snow tool in accordance with claim 6 wherein said ribs of said blade comprise flared ribs converging laterally inwardly, away from said curved sidewalls of said blade and towards said axis of said ribbed handle in a direction towards said upper portion of said blade for channeling snow inwardly to facilitate pushing and shoveling of snow and for preventing said channeled snow from falling off said leading edge of said blade.

9. A snow tool in accordance with claim 8 including a metal wear-resistant strip secured to said leading edge of said curved blade.

10. A snow tool in accordance with claim 8 wherein said concave front surface of said combination snow blade has a radius of curvature ranging from about 5.4 inches to about 5.6 inches and said concave upper edges of said sidewalls of said combination snow blade have a radius of curvature ranging from about 6.4 inches to about 6.9 inches.

* * * * *